US011169465B2

(12) United States Patent
Nishimura

(10) Patent No.: US 11,169,465 B2
(45) Date of Patent: Nov. 9, 2021

(54) IMAGE FORMING APPARATUS INCLUDING INPUT ELEMENT, OUTPUT ELEMENT AND TRANSMISSION ELEMENT FOR TRANSMITTING DRIVING FORCE OF MOTOR TO ROLLER

(71) Applicant: BROTHER KOGYO KABUSHIKI KAISHA, Nagoya (JP)

(72) Inventor: Shoichiro Nishimura, Yokkaichi (JP)

(73) Assignee: BROTHER KOGYO KAB USHIKI KAISHA, Nagoya (JP)

( * ) Notice: Subject to any disclaimer, the term of this patent is extended or adjusted under 35 U.S.C. 154(b) by 0 days.

(21) Appl. No.: 17/119,474

(22) Filed: Dec. 11, 2020

(65) Prior Publication Data

US 2021/0200116 A1 Jul. 1, 2021

(30) Foreign Application Priority Data

Dec. 27, 2019 (JP) ..... JP2019-237868

(51) Int. Cl.
*G03G 15/00* (2006.01)
*G03G 15/08* (2006.01)
*G03G 21/16* (2006.01)

(52) U.S. Cl.
CPC ..... *G03G 15/0808* (2013.01); *G03G 21/1647* (2013.01); *G03G 21/1676* (2013.01)

(58) Field of Classification Search
CPC ..... G03G 15/0806; G03G 15/0808; G03G 21/1647; G03G 21/1676
See application file for complete search history.

(56) References Cited

U.S. PATENT DOCUMENTS

| | | | | |
|---|---|---|---|---|
| 2010/0104311 | A1* | 4/2010 | Okamoto | G03G 15/6502 399/75 |
| 2012/0243908 | A1* | 9/2012 | Aratachi | G03G 15/0806 399/167 |
| 2014/0126932 | A1 | 5/2014 | Iijima | |
| 2017/0152116 | A1* | 6/2017 | Hashimoto | B65H 3/0684 |
| 2020/0004198 | A1* | 1/2020 | Nakano | G03G 21/1676 |
| 2020/0310281 | A1* | 10/2020 | Haruta | G03G 21/1676 |
| 2021/0011427 | A1* | 1/2021 | Saeki | G03G 21/1676 |

FOREIGN PATENT DOCUMENTS

| | | | |
|---|---|---|---|
| JP | 5-60204 | A | 3/1993 |
| JP | 2013-113971 | A | 6/2013 |
| JP | 2014-40843 | A | 3/2014 |
| JP | 2014-95416 | A | 5/2014 |

* cited by examiner

*Primary Examiner* — Sophia S Chen
(74) *Attorney, Agent, or Firm* — Merchant & Gould P.C.

(57) ABSTRACT

An image forming apparatus includes: a motor; a roller; and a power transmission device for transmitting a driving force of the motor to the roller. The power transmission device includes: a planetary gear mechanism including a first helical gear into which the driving force is inputted, a second helical gear for outputting the driving force to the roller, and a transmission element; and a restriction member. The transmission element can transmit the driving force when the restriction member is in its restricting position and thus rotation of the transmission element is restricted, and interrupts transmission of the driving force when the restricting member is in its non-restricting position and thus rotation of the transmission element is not restricted. A direction of a first thrust force applied to the first helical gear and a direction of a second thrust force applied to the second helical gear are opposite to each other.

11 Claims, 12 Drawing Sheets

IMAGE FORMING APPARATUS INCLUDING INPUT ELEMENT, OUTPUT ELEMENT AND TRANSMISSION ELEMENT FOR TRANSMITTING DRIVING FORCE OF MOTOR TO ROLLER

CROSS REFERENCE TO RELATED APPLICATION

This application claims priority from Japanese Patent Application No. 2019-237868 filed Dec. 27, 2019. The entire content of the priority application is incorporated herein by reference.

TECHNICAL FIELD

The present disclosure relates to an image forming apparatus including a power transmission device capable of transmitting a driving force of a motor to a roller.

BACKGROUND

There has been known a power transmission device for transmitting a driving force of a motor to a roller. A conventional power transmission device includes a planetary gear mechanism, a ratchet portion, a regulation arm, and a switching unit (refer to Japanese Patent Application Publication No. 2013-113971). The planetary gear mechanism includes a sun gear, a ring gear, a carrier, and planetary gears. The ratchet portion is provided integrally with the sun gear, and provided for transmitting the driving force inputted into the ring gear to the carrier. The ratchet portion can transmit the driving force to the carrier when rotation of the ratchet portion is restricted, whereas the ratchet portion does not transmit the driving force to the carrier when the ratchet portion is freely rotatable.

The regulation arm includes a pawl engageable with a protrusion of the ratchet portion. The switching unit includes a spring and a solenoid, and is configured to switch a state of the ratchet portion between a state where the rotation of the ratchet portion is restricted and a state where the ratchet portion is freely rotatable. In the state where the rotation of the ratchet portion is restricted, the pawl of the regulation arm is engaged with the protrusion of the ratchet portion due to an urging force of the spring to stop rotation of the ratchet portion. In the state where the ratchet portion is rotatable, the pawl of the regulation arm is moved away from the protrusion by the solenoid to allow the ratchet portion to be rotated.

SUMMARY

In the meantime, it is desired that a planetary gear mechanism has a configuration that can be driven stably.

In view of the foregoing, it is an object of the disclosure to provide an image forming apparatus in which a planetary gear mechanism can be driven stably.

In order to attain the above and other objects, according to one aspect, the disclosure provides an image forming apparatus including: a motor; a roller; and a power transmission device. The power transmission device is capable of transmitting a driving force of the motor to the roller. The power transmission device includes: a planetary gear mechanism; and a restriction member. The planetary gear mechanism includes: an input element; an output element; and a transmission element. The input element includes a first helical gear into which the driving force of the motor is inputted. The output element includes a second helical gear for outputting the driving force to the roller. The transmission element is rotatable to transmit the driving force from the input element to the output element. The transmission element is capable of transmitting the driving force from the input element to the output element when rotation of the transmission element is restricted, whereas the transmission element does not transmit the driving force from the input element to the output element when the rotation of the transmission element is not restricted. The restriction member is movable between: a restricting position where the restriction member restricts the rotation of the transmission element; and a non-restricting position where the restriction member does not restrict the rotation of the transmission element. The input element, the output element, and the transmission element are rotatable coaxially. The input element and the output element are positioned adjacent to each other in an axial direction of the planetary gear mechanism. The first helical gear and the second helical gear are provided so that a direction of a first thrust force applied to the first helical gear and a direction of a second thrust force applied to the second helical gear are opposite to each other.

According to another aspect, the disclosure provides an image forming apparatus including: a motor; a roller; and a power transmission device. The power transmission device capable of transmitting a driving force of the motor to the roller. The power transmission device includes: a planetary gear mechanism; and a restriction member. The planetary gear mechanism includes: a first helical gear into which the driving force of the motor is inputted; a second helical gear for outputting the driving force to the roller; and a transmission element rotatable to transmit the driving force from the first helical gear to the second helical gear. The transmission element is capable of transmitting the driving force from the first helical gear to the second helical gear when rotation of the transmission element is restricted, whereas the transmission element does not transmit the driving force from the first helical gear to the second helical gear when the rotation of the transmission element is not restricted. The restriction member is movable between: a restricting position where the restriction member restricts the rotation of the transmission element; and a non-restricting position where the restriction member does not restrict the rotation of the transmission element. The first helical gear and the second helical gear are positioned adjacent to each other in an axial direction of the planetary gear mechanism. The first helical gear and the second helical gear are helical gears of the same hand.

BRIEF DESCRIPTION OF THE DRAWINGS

The particular features and advantages of the embodiment (s) as well as other objects will become apparent from the following description taken in connection with the accompanying drawings, in which.

DETAILED DESCRIPTION

Figure 1:
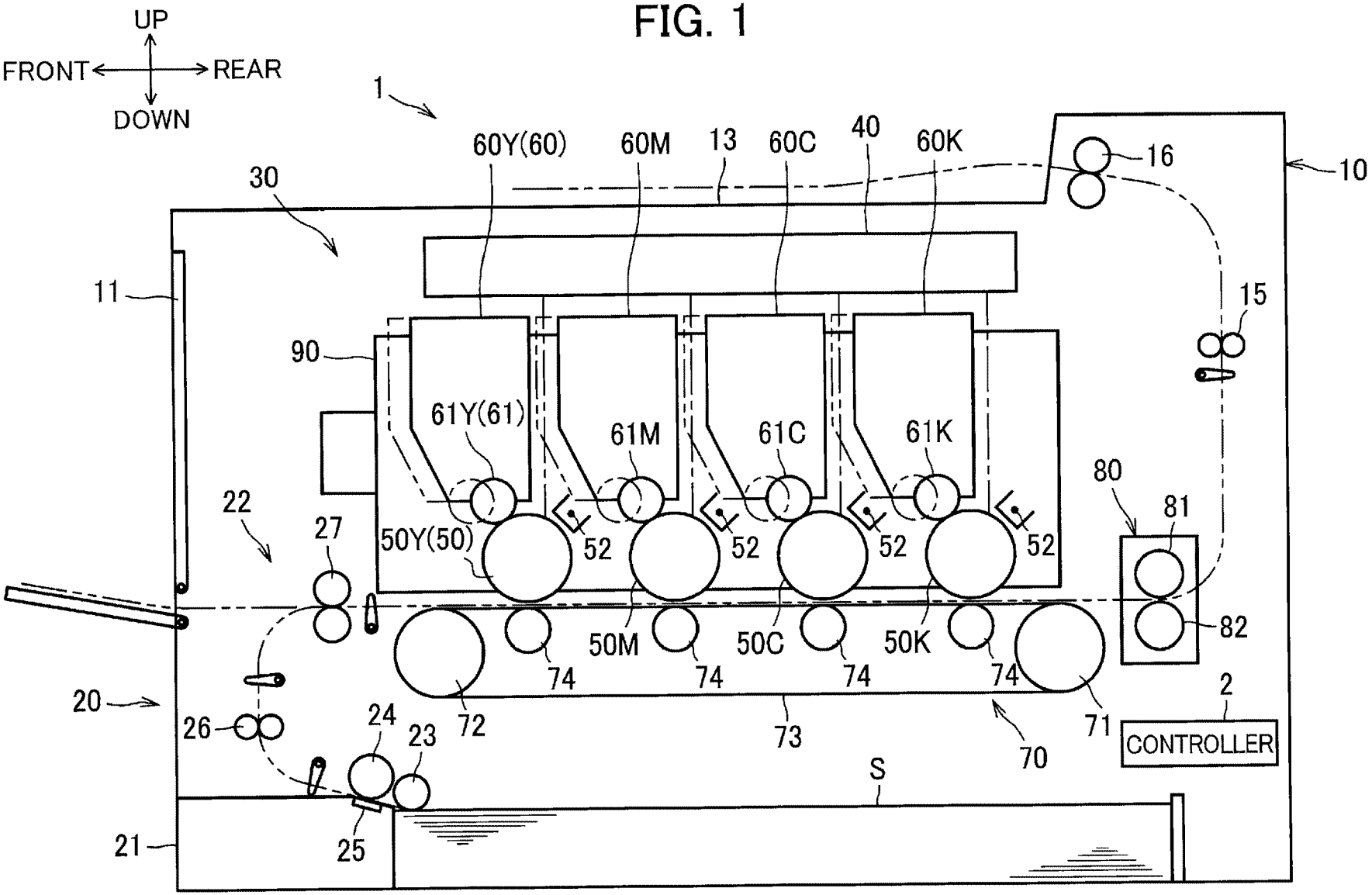
FIG. 1 is a schematic view illustrating an overall configuration of an image forming apparatus according to one embodiment of the present disclosure.

Hereinafter, an image forming apparatus 1 according to one embodiment of the present disclosure will be described with reference to FIGS. 1 through 12.

In the following description, the left side, the right side, the upper side, the lower side, the near side and the far side in FIG. 1 will be referred to as the front side, the rear side, the upper side, the lower side, the right side and the left side, respectively.

The image forming apparatus 1 according to the embodiment is a color printer and includes a housing 10, a sheet feed unit 20, an image forming unit 30, and a controller 2.

The sheet feed unit 20 includes a sheet tray 21 in which sheets S can be accommodated, and a sheet feed mechanism 22. The sheet tray 21 is positioned below the image forming unit 30, and is detachable from the housing 10 by pulling the sheet tray 21 frontward out of the housing 10. The sheet feed mechanism 22 includes a sheet feed roller 23, a separation roller 24, a separation pad 25, a pair of conveyer rollers 26, and a pair of registration rollers 27. The sheet S can be used as an image recording medium on which the image forming apparatus 1 can form an image. A plain paper, an envelope, a post card, a thin paper, a thick paper, a calendered paper, a resin sheet, and a seal are examples of the sheet S.

The sheets S accommodated in the sheet tray 21 are fed by the sheet supply roller 23, and separated one by one by the separation roller 24 and the separation pad 25 to be conveyed toward the registration rollers 27 by the conveyer rollers 26. Thereafter, a position of the leading edge of the sheet S is regulated by the registration rollers 27 whose rotation has been stopped, and then, the sheet S is fed to the image forming unit 30 by the rotation of the registration rollers 27.

The image forming unit 30 includes an exposure unit 40, a plurality of photosensitive drums 50, a plurality of developing cartridges 60, a conveying unit 70, and a fixing unit 80. The exposure unit 40 includes a laser diode, a deflector, lenses, and mirrors those not illustrated. The exposure unit 40 is configured to emit a plurality of laser beams indicated by a dotted chain lines in FIG. 1 to expose surfaces of the plurality of drums 50 to light.

The photosensitive drums 50 include a Y photosensitive drum 50Y for a color of yellow, a M photosensitive drum 50M for a color of magenta, a C photosensitive drum 50C for a color of cyan, and a K photosensitive drum 50K for a color of black.

Throughout the specification and drawings, in a case where colors must be specified, members or components corresponding to the colors of yellow, magenta, cyan and black are designated by reference numerals followed by "Y", "M", "C" and "K", respectively. On the other hand, in a case where distinction of colors is unnecessary, the addition of "Y", "M", "C", "K" is omitted.

The developing cartridges 60 are provided in one-to-one correspondence to the photosensitive drums 50. The developing cartridges 60 include a Y developing cartridge 60Y, an M developing cartridge 60M, a C developing cartridge 60C, and a K developing cartridge 60K. The Y developing cartridge 60Y includes a Y developing roller 61Y for supplying toner to the Y photosensitive drum 50Y; the M developing cartridge 60M includes an M developing roller 61M for supplying toner to the M photosensitive drum 50M; the C developing cartridge 60C includes a C developing roller 61C for supplying toner to the C photosensitive drum 50C; and the K developing cartridge 60K includes a K developing roller 61K for supplying toner to the K photosensitive drum 50K.

As illustrated in FIG. 1, each of the developing cartridges 60 is movable between a position indicated by a solid line where the developing roller 61 is in its contact position and a position indicated by a two-dotted chain line where the developing roller 61 is in its separated position. When the developing roller is in the contact position, the developing roller 61 is in contact with the corresponding photosensitive drum 50. When in the separated position, the developing roller 61 is separated from the corresponding photosensitive drum 50.

Each of the photosensitive drums 50 is rotatably supported by a support member 90 (see FIG. 1). On the support member 90, four chargers 52 are provided in one-to-one correspondence to the photosensitive drums 50 for charging the corresponding photosensitive drums 50. The support member 90 is attachable to and detachable from the housing 10 through an opening of the housing 10 by opening a front cover 11. The plurality of developing cartridges 60 are detachably supported by the support member 90.

The conveying unit 70 is disposed between the sheet tray 21 and the plurality of photosensitive drums 50. The conveying unit 70 includes a drive roller 71, a driven roller 72, a conveyer belt 73, and four transfer rollers 74. The conveyer belt 73 is an endless belt looped over the drive roller 71 and the driven roller 72 with taut, and has an outer surface facing the plurality of photosensitive drums 50. Each transfer roller 74 is disposed to face an inner surface of the conveyer belt 73, and is configured to nip the conveyer belt 73 in cooperation with the corresponding photosensitive drums 50.

The fixing unit 80 is disposed at a position rearward of the plurality of photosensitive drums 50 and the conveying unit 70. The fixing unit 80 includes a heat roller 81 and a pressure roller 82 facing the heat roller 81. A pair of conveying rollers 15 and a pair of discharge rollers 16 are disposed downstream of the fixing unit 80 in a conveying direction in which the sheet S is conveyed.

In the image forming unit 30, the surface of each of the photosensitive drums 50 is uniformly charged by the corresponding one of the chargers 52, then is exposed to light by the exposure unit 40. In this way, an electrostatic latent image corresponding to image data is formed on the surface of the photosensitive drum 50. In the meantime, toner accommodated in the developing cartridge 60 is carried onto a surface of the developing roller 61, and is supplied to the electrostatic latent image formed on the surface of the corresponding photosensitive drum 50 when the developing roller 61 is in the contact position, thereby forming a toner image onto the surface of the photosensitive drum 50.

Then, the toner image formed on the photosensitive drums 50 is transferred to the sheet S while the sheet S fed onto the conveyer belt 73 passes between the photosensitive drum 50 and the transfer roller 74. After that, the sheet S passes between the heat roller 81 and the pressure roller 82, and the toner image is thermally fixed to the sheet S. The sheet S is then discharged onto the discharging tray 13 by the conveying rollers 15 and the discharge rollers 16.

Figure 2:
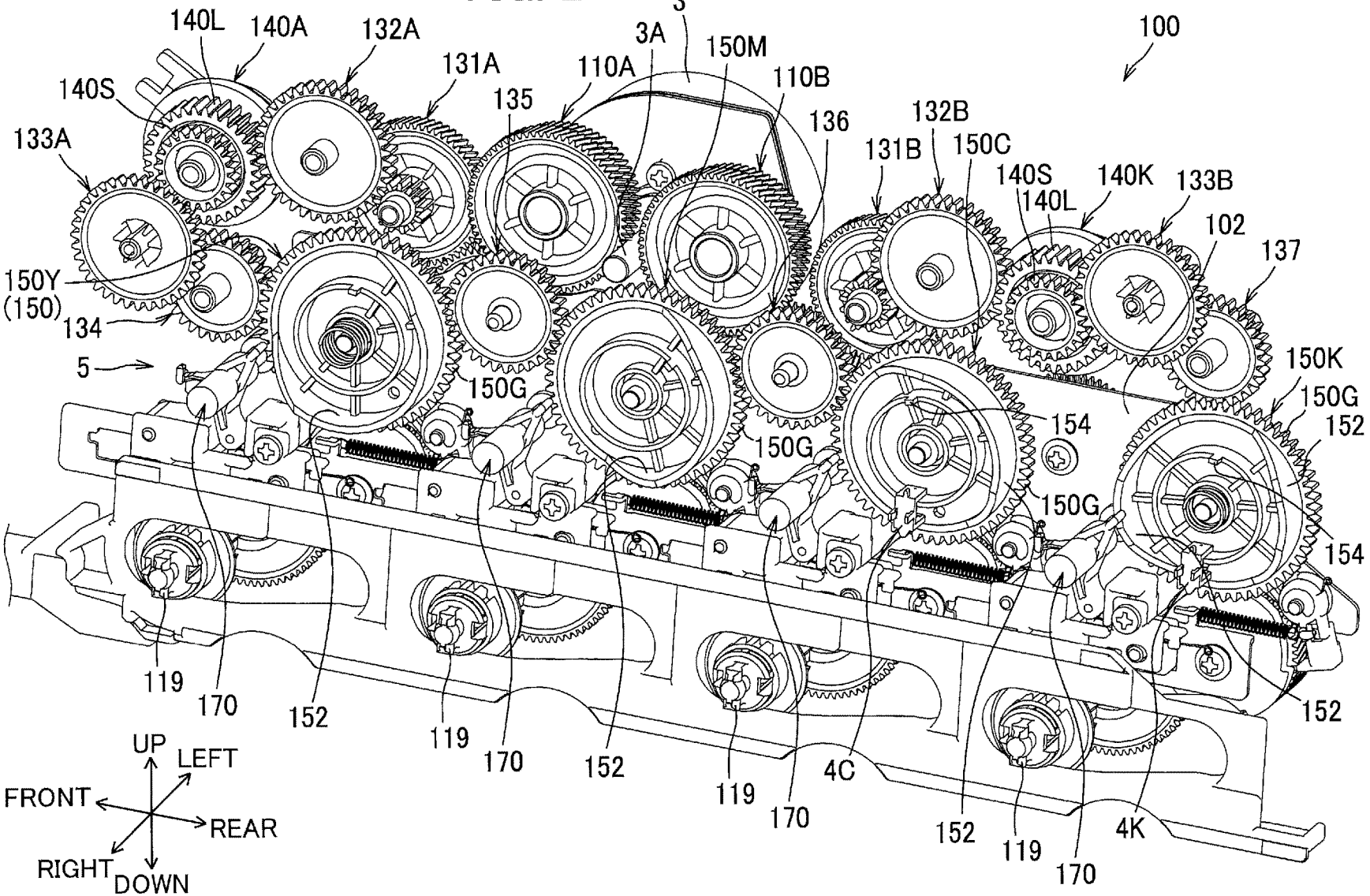
FIG. 2 is a schematic view illustrating a motor, a power transmission mechanism, and a transfer mechanism in the image forming apparatus according to the embodiment as viewed from the upper-right side thereof.

Next, a structure for driving and stopping the developing rollers 61, and a structure for moving the developing rollers 61 to contact and separate from the corresponding photosensitive drums 50 will be described. As illustrated in FIG. 2, the image forming apparatus 1 includes a motor 3, a drive transmission mechanism 100, and a transfer mechanism 5.

The motor 3 is configured to drive the developing rollers 61 and cams 150 (150Y, 150M, 150C and 150K those described later) of the transfer mechanism 5. The motor 3 is a motor that can make forward rotation and reverse rotation. In the present embodiment, a rotational direction of the motor 3 when the image forming apparatus 1 performs an image forming operation will be referred to as "forward rotation", whereas a rotational direction of the motor 3 opposite the forward rotation will be referred to as "reverse rotation". The motor 3 includes an output shaft 3A that is driven to rotate. A gear (not illustrated) is coupled to the output shaft 3A. Rotation of the motor 3 is controlled by the controller 2.

Figure 3:
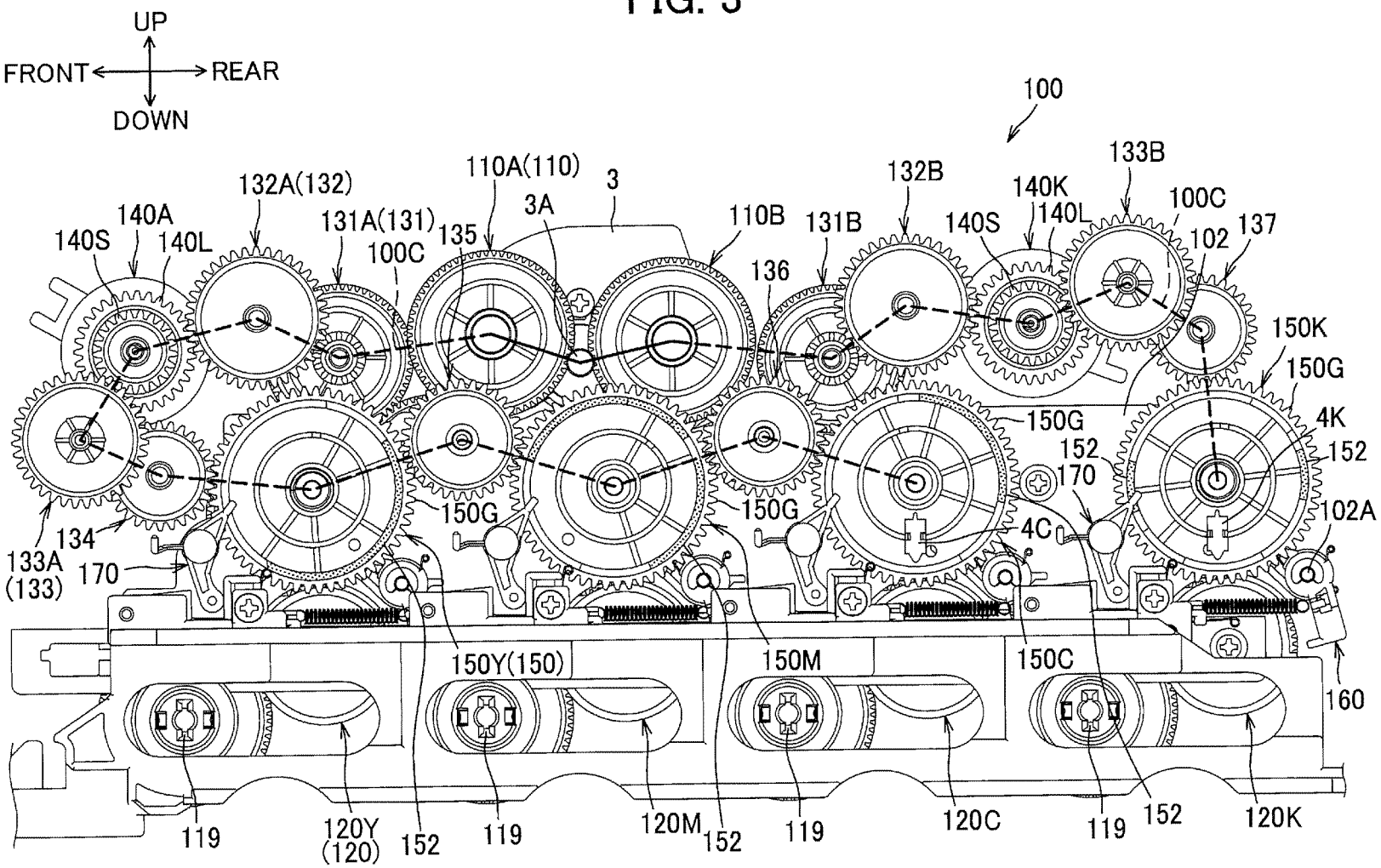
FIG. 3 is a side view illustrating the motor, the power transmission mechanism, and the transfer mechanism in the image forming apparatus according to the embodiment as viewed from the right side thereof.
Figure 4:
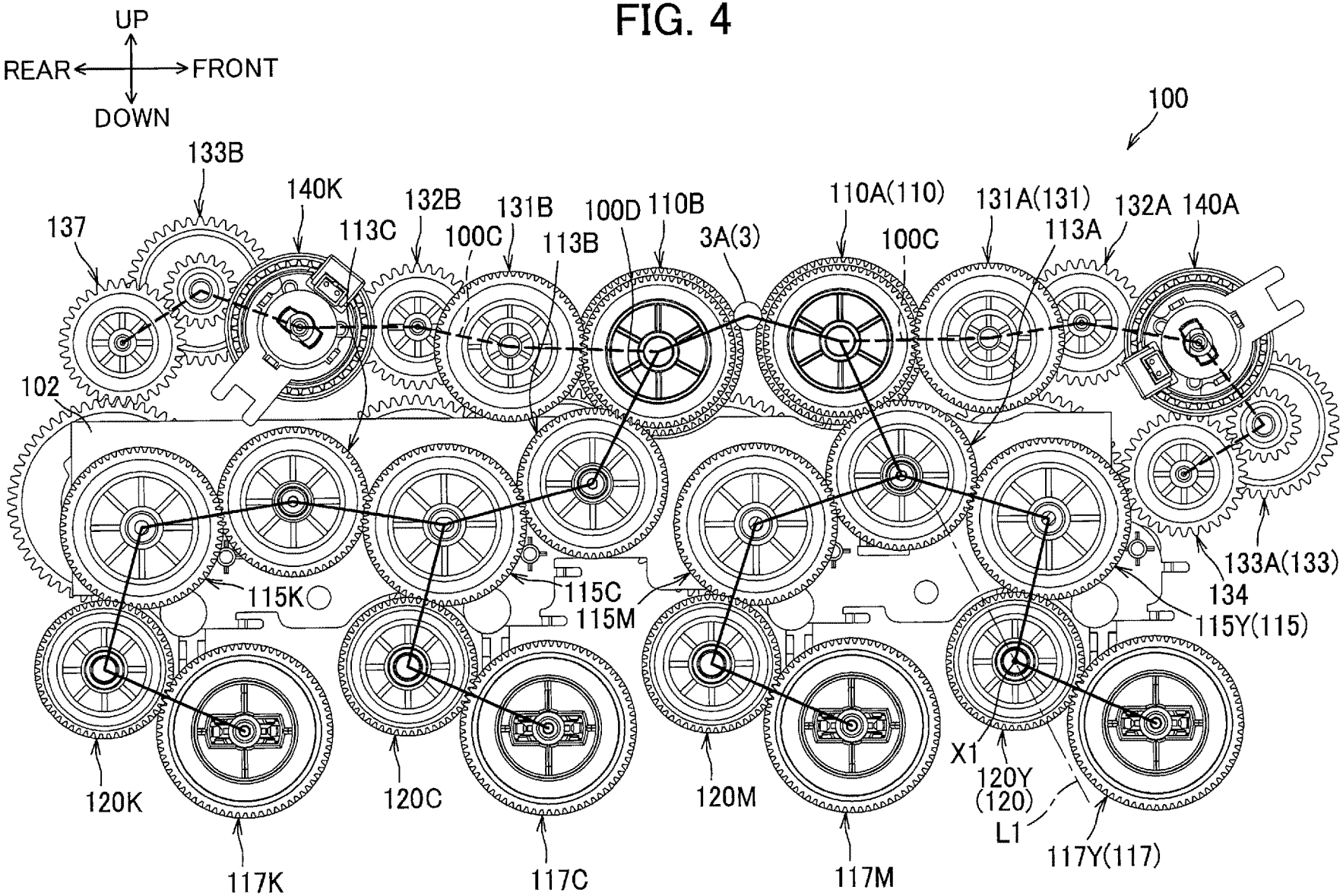
FIG. 4 is a side view illustrating the power transmission mechanism in the image forming apparatus according to the embodiment as viewed from left side thereof.

The drive transmission mechanism 100 is configured to transmit a driving force of the motor 3 to the developing rollers 61 and the cams 150. As illustrated in FIGS. 3 and 4, the drive transmission mechanism 100 includes a first gear train 100D for transmitting the driving force of the motor 3 to the developing rollers 61, and a second gear train 100C for transmitting the driving force of the motor 3 to the cams 150. Note that, in FIGS. 3 and 4, meshing engagement between gears constituting the first gear train 100D is indicated by a bold solid line, and meshing engagement between gears constituting the second gear train 100C is indicated by a bold dashed line.

As illustrated in FIG. 4, the first gear train 100D includes idle gears 110 (110A and 110B), 113 (113A, 113B and 113C), 115 (115Y, 115M, 115C and 115K), clutches 120 (120Y, 120M, 120C and 120K) as an example of a power transmission device, and coupling gears 117 (117Y, 117M, 117C and 117K). Each of the gears constituting the first gear train 100D is supported by one of a first plate 101 (see FIGS. 11 and 12) and a second plate 102, and is rotatable about a rotation axis extending in axial directions of the photosensitive drums 50.

Each of the coupling gears 117 is in meshing engagement with the corresponding one of the clutches 120, and includes a coupling shaft 119 (see FIG. 2) integrally rotatable with a gear portion of the coupling gear 117. Each of the coupling shafts 119 is movable in axial directions of the developing rollers 61 in interlocking relation to opening and closing movement of the front cover 11 (see FIG. 1). As the front cover 11 is closed, the coupling shaft 119 is engaged with a coupling (not illustrated) of the corresponding developing cartridge 60 to transmit the driving force of the motor 3 to the developing roller 61 of the corresponding developing cartridge 60.

The driving force of the motor 3 is transmitted to the coupling gear 117Y for the color of yellow through the idle gears 110A, 113A and 115Y and the clutch 120Y. The driving force of the motor 3 is transmitted to the coupling gear 117M for the color of magenta through the idle gears 110A, 113A and 115M and the clutch 120M. The driving force of the motor 3 is transmitted to the coupling gear 117C for the color of cyan through the idle gears 110B, 113B and 115C and the clutch 120C. The driving force of the motor 3 is transmitted to the coupling gear 117K for the color of black through the idle gears 110B, 113B, 115C, 113C and 115K and the clutch 120K. Details of the clutches 120 will be described later.

As illustrated in FIG. 3, the second gear train 100C includes idle gears 131 (131A and 131B), 132 (132A and 132B), 133 (133A and 133B), 134, 135, 136 and 137, a YMC clutch 140A, and a K clutch 140K. Each of the gears constituting the second gear train 100C is supported by one of the first plate 101 and the second plate 102, and is rotatable about a rotation axis extending in the axial directions of the photosensitive drums 50.

The YMC clutch 140A is configured to switch transmission and interruption of the driving force of the motor 3 to switch rotation and halt of each of the cams 150Y, 150M and 150C. The YMC clutch 140A includes a large diameter gear 140L in meshing engagement with the idle gear 132A and a small diameter gear 140S in meshing engagement with the idle gear 133A.

The K clutch 140K is configured to switch transmission and interruption of the driving force of the motor 3 to switch rotation and halt of the cam 150K. The K clutch 140K has a configuration identical to that of the YMC clutch 140A. The K clutch 140K has a large diameter gear 140L in meshing engagement with the idle gear 132B, and the K clutch 140K has a small diameter gear 140S is in meshing engagement with the idle gear 133B.

Each of the YMC clutch 140A and the K clutch 140K is an electromagnetic clutch. These clutches 140A and 140K are switched to its ON state upon energization to cause the large diameter gear 140L and the small diameter gear 140S to be integrally rotated, and are switched to its OFF state upon de-energization to cause the large diameter gear 140L to make idle rotation and the small diameter gear 140S to stop rotation. The YMC clutch 140A and the K clutch 140K are controlled by the controller 2 to be switched between the ON state and the OFF state.

The driving force of the motor 3 is transmitted to the cam 150Y for the color of yellow through the idle gears 110A, 131A and 132A, the YMC clutch 140A, and the idle gears 133A and 134. The driving force of the motor 3 is transmitted to the cam 150M for the color of magenta through the cam 150Y and the idle gear 135. The driving force of the motor 3 is transmitted to the cam 150C for the color of cyan through the 150M and the idle gear 136. Each of the cams 150Y, 150M and 150C starts rotation concurrently upon turning on the YMC clutch 140A, and stops rotation upon turning off the YMC clutch 140A.

The driving force of the motor 3 is transmitted to the cam 150K for the color of black through the idle gears 110B, 131B and 132B, the K clutch 140K, and the idle gears 133B and 137. The black cam 150K starts rotation upon turning on the K clutch 140K, and stops rotation upon turning off the K clutch 140K.

The transfer mechanism 5 is configured to move the developing rollers 61 between the contact positions and the separated positions. Specifically, the transfer mechanism 5 is configured to move each of the developing rollers 61 between the contact position and the separated position upon receipt of the driving force from the motor 3 not only when the motor 3 makes forward rotation but also the motor 3 makes reverse rotation. The transfer mechanism 5 includes the plurality of cams 150 (150Y, 150M, 150C and 150K), and a plurality of cam followers 170 provided in one-to-one correspondence to the plurality of cams 150.

Figure 5A:
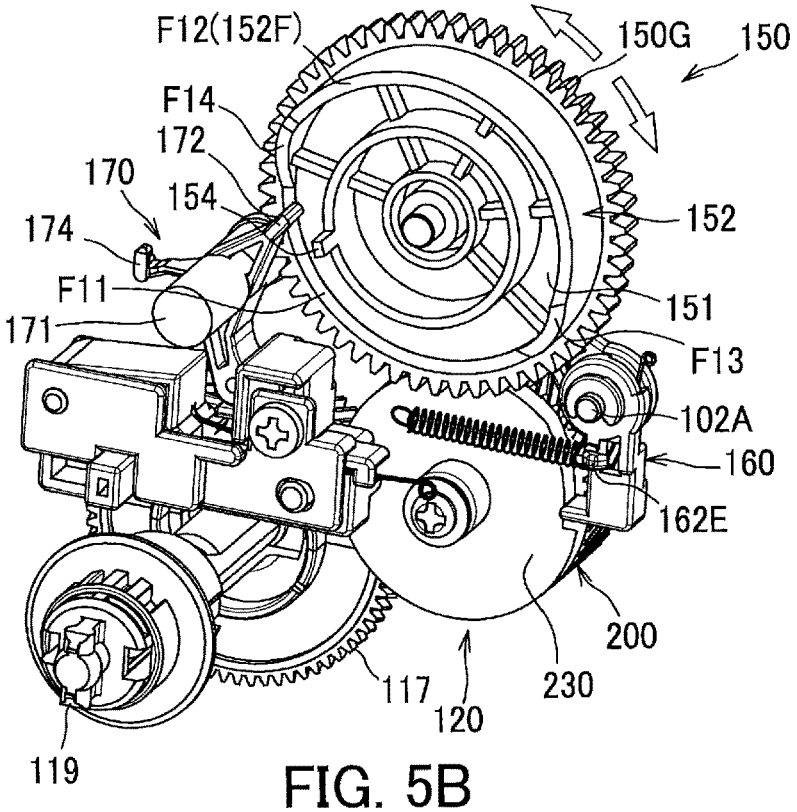
FIG. 5A is a perspective view illustrating a cam, a cam follower, a planetary gear mechanism and a regulation member in the image forming apparatus according to the embodiment, and particularly illustrating a state where a developing roller is in its contact position and a clutch is in its transmission state.
Figure 5B:
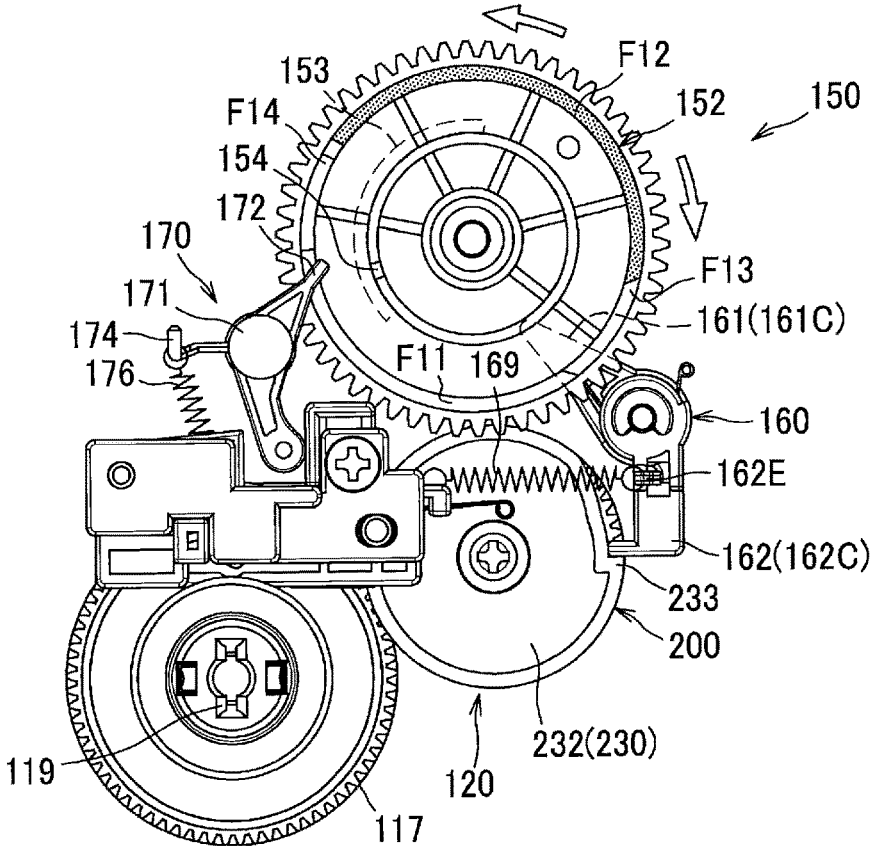
FIG. 5B is a side view illustrating the cam, the cam follower, the planetary gear mechanism and the regulation member in the image forming apparatus according to the embodiment, and particularly illustrating a state where the developing roller is in its contact position and the clutch is in its transmission state.

Each of the cams 150 is rotatable to move the corresponding one of the developing rollers 61 between the contact position and the separated position. As illustrated in FIGS. 5A and 5B, each of the cams 150 includes a disc portion 151, a gear portion 150G provided at an outer periphery of the disc portion 151, at least one first cam portion 152, a second cam portion 153, and a counterpart detection portion 154.

The first cam portion 152 is configured to move the developing roller 61 between the contact position and the separated position, and protrudes from one surface of the disc portion 151 in the axial direction of the developing roller 61. The first cam portion 152 has an end face functioning as a cam surface 152F. The cam surface 152F includes a first holding surface F11, a second holding surface F12, a first guide surface F13, and a second guide surface F14.

The first holding surface F11 is a surface for holding the cam follower 170 at its standby position (described later; see FIG. 6A). The second holding surface F12 is a surface for holding the cam follower 170 at its protruding position (described later; see FIG. 6B). The first guide surface F13 connects the first holding surface F11 and the second holding surface F12 to each other, and is inclined relative to the first holding surface F11. The second guide surface F14 connects the second holding surface F12 and the first holding surface F11 to each other, and is inclined relative to the first holding surface F11. Note that the second holding surface F12 is indicated by a hatched area in FIG. 5B.

The second cam portion 153 is configured to switch transmission and interruption of the driving force by the corresponding clutch 120 in cooperation with a regulation member 160 (described later). The second cam portion 153 protrudes from a surface of the disc portion 151 opposite the surface on which the first cam portion 152 is provided in the axial direction of the developing roller 61. The second cam portion 153 has a generally arcuate shape as viewed in the axial direction.

The first cam portion 152 and the second cam portion 153 are formed integrally with the disc portion 151. With this configuration, the second cam portion 153 is rotatable together with the first cam portion 152.

The counterpart detection portion 154 is configured to indicate a phase or rotational position of the cam 150. The counterpart detection portion 154 is positioned radially inward of the first cam portion 152, and protrudes in the axial direction of the developing roller 61 from the disc portion 151. The counterpart detection portions 154 of the cam 150C for the color of cyan and the cam 150K for the color of black are configured to be detected by separation sensors 4C and 4K (described later), respectively.

As illustrated in FIG. 2, the cams 150Y, 150M and 150C have configurations the same as one another except that a length of the first cam portion 152 of the cam 150Y in the rotational direction thereof is greater than lengths of the first cam portions 152 of the cams 150M and 150C in the rotational direction. Further, the cam 150K has two first cam portions 152 each having a length in the rotational direction smaller than that of the first cam portions 152 of the cams 150Y, 150M and 150C.

Referring back to FIGS. 5A and 5B, each of the cam followers 170 includes a slide shaft portion 171, a contact portion 172, and a spring hook 174. The slide shaft portion 171 is slidable relative to a support shaft 179 (see FIGS. 6A and 6B) provided in the housing 10 so as to be movable in the axial direction of the developing roller 61. Hence, the cam follower 170 is slidably movable in the axial direction.

The contact portion 172 can contact the cam surface 152F of the first cam portion 152, and extends from the slide shaft portion 171. The cam follower 170 is slidingly movable between the protruding position illustrated in FIG. 6B and the standby position illustrated in FIG. 6A. In the protruding position of the cam follower 170, the contact portion 172 is in contact with the second holding surface F12 to position the developing roller 61 at the separated position. In the standby position of the cam follower 170, the contact portion 172 is in contact with the first holding surface F11 to position the developing roller 61 at the contact position.

As illustrated in FIG. 5B, the spring hook 174 is a part with which one end of a spring is engaged and extends from the slide shaft portion 171 in a direction different from a direction in which the contact portion 172 extends. The spring 176 is a tension spring that has another end engaged with a spring hook (not illustrated) provided on the second plate 102 at a position lower than the spring hook portion 174. The spring 176 urges the cam follower 170 toward the standby position.

Figure 6A:
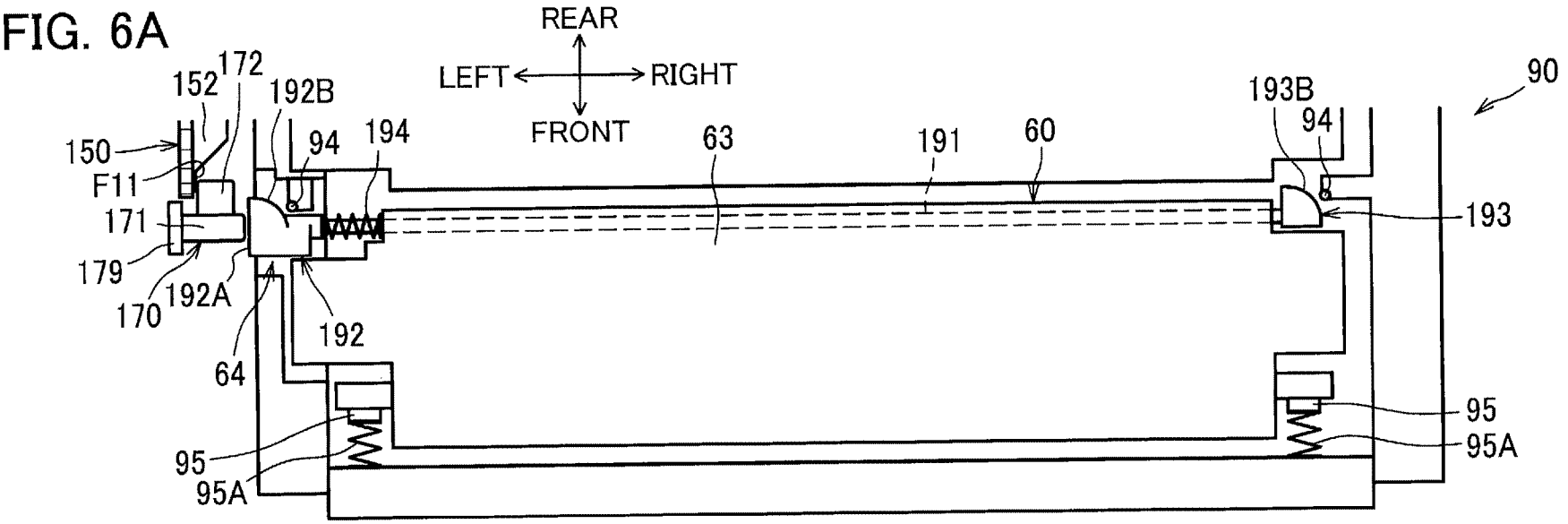
FIG. 6A is a schematic top view illustrating the developing cartridge and components in the vicinity thereof in the image forming apparatus according to the embodiment, and particularly illustrating the state where the cam follower is its standby position.
Figure 6B:
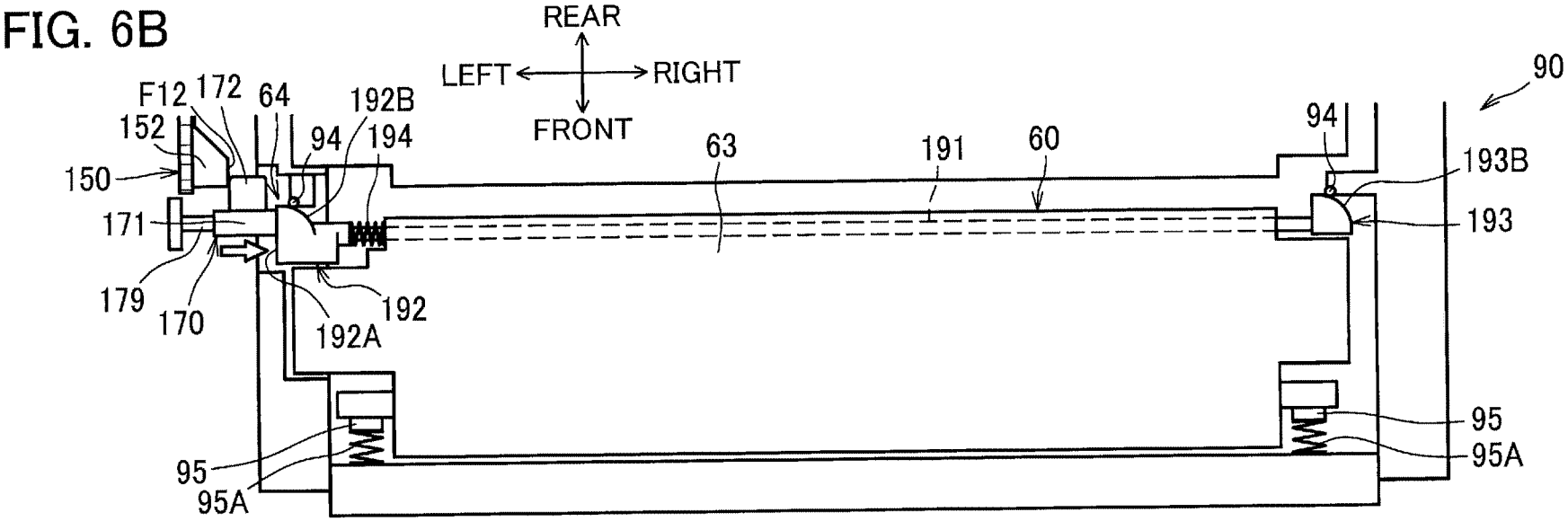
FIG. 6B is a schematic top view illustrating the developing cartridge and components in the vicinity thereof in the image forming apparatus according to the embodiment, and particularly illustrating a state where the cam follower is its protruding position.

As illustrated in FIGS. 6A and 6B, the developing cartridge 60 is supported by the support member 90 to be movable relative to the support member 90 in a front-rear direction. The support member 90 includes counterpart abutment portions 94 and pressure members 95.

Each of the counterpart abutment portions 94 is a roller rotatable about an axis extending in an up-down direction. A slide member 64 (described later) of the corresponding developing cartridge 60 can abut against the counterpart abutment portions 94. Each of the pressure members 95 is urged rearward by a spring 95A. When the developing cartridge 60 has been attached to the support member 90, the pressure members 95 press the developing cartridge 60 to move the developing roller 61 to be brought into contact with the corresponding photosensitive drum 50, i.e., to move the developing roller 61 to the contact position.

The developing cartridge 60 includes a casing 63 configured to accommodate therein toner, and the slide member 64. As the slide member 64 is pressed by the cam follower 170, the slide member 64 is slidingly movable relative to the casing 63 in the axial direction of the developing roller 61. The slide member 64 includes a shaft 191 supported by the casing 63 so as to be slidingly movable, a first abutment member 192 connected to one end of the shaft 191, and a second abutment member 193 connected to another end of the shaft 191.

The first abutment member 192 has a pressure receiving surface 192A and a sloped surface 192B inclined relative to the axial direction. The second abutment member 193 has a sloped surface 193B inclined in the same way as the sloped surface 192B. The pressure receiving surface 192A is a surface to be pressed by the cam follower 170. The sloped surfaces 192B and 193B are brought into abutment with the counterpart abutment portions 94, respectively, in response to movement in the axial direction of the slide member 64 pressed by the cam follower 170 to urge the developing cartridge 60 in a direction perpendicular to the axial direction, thereby moving the developing roller 61 away from the corresponding photosensitive drum 50 to the separated position. A spring 194 is interposed between the first abutment member 192 and the casing 63 to urge the slide member 64 leftward.

As illustrated in FIG. 2, the image forming apparatus 1 includes separation sensors 4C and 4K provided for the cam 150C for the color of cyan and the cam 150K for the color of black, respectively. The separation sensors 4C and 4K are phase sensors or displacement sensors for detecting a starting point of a phase or rotational position of the respective cams 150C and 150K. Each of the separation sensors 4C and 4K are configured to output a signal at a timing when the corresponding cam 150C or 150K is positioned within a predetermined phase range where the corresponding developing roller 61C or 61K is at the separated position, and does not output a signal at a timing when the cam 150C or 150K is positioned outside of the predetermined phase range.

Each of the separation sensors 4C and 4K includes a light emitting portion configured to emit a detection light and a light receiving portion configured to receive the detection light emitted from the light emitting portion. In a state where the counterpart detection portion 154 of the corresponding cam 150C or 150K is positioned between the light emitting portion and the light receiving portion to block the detection light so that the light receiving portion cannot receive the detection light, each of the separation sensors 4C and 4K outputs a signal to the controller 2. On the other hand, in a state where the counterpart detection portion 154 is displaced from the path of the detection light so that the light receiving portion can receive the detection light, each of the separation sensors 4C and 4K does not output a signal to the controller 2.

Note that the cams 150Y and 150M have parts having shapes the same as that of the counterpart detection portion 154 of the cams 150C and 150K. However, any separation sensors for the parts in the cams 150Y and 150K are not provided, and therefore, the parts do not function as the counterpart detection portion 154 does.

Next, the configuration of the clutches 120 will be described in detail.

Each of the clutches 120 is configured to transmit a driving force of the motor 3 to the corresponding one of the developing rollers 61. Specifically, each of the clutches 120 is switchable between a transmission state (a state illustrated in FIGS. 5A and 5B) where the driving force of the motor 3 can be transmitted to the corresponding developing roller 61 and an interruption state (a state illustrated in FIGS. 9A and 9B) where transmission of the driving force of the motor 3 to the developing roller 61 has been interrupted. The developing roller 61 is an example of a roller.

Each of the clutches 120 includes a planetary gear mechanism 200 and the regulation member 160.

Figure 7A:
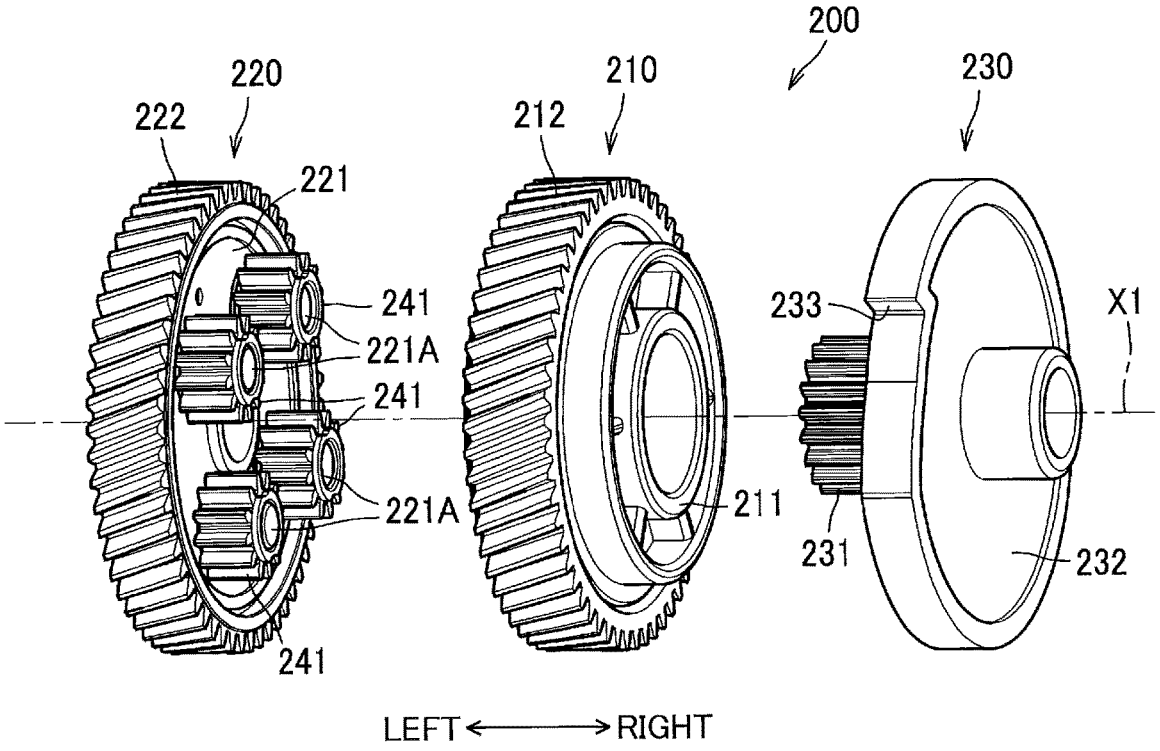
FIG. 7A is an exploded perspective view illustrating the planetary gear mechanism in the image forming apparatus according to the embodiment as viewed from a transmission element side thereof.
Figure 7B:
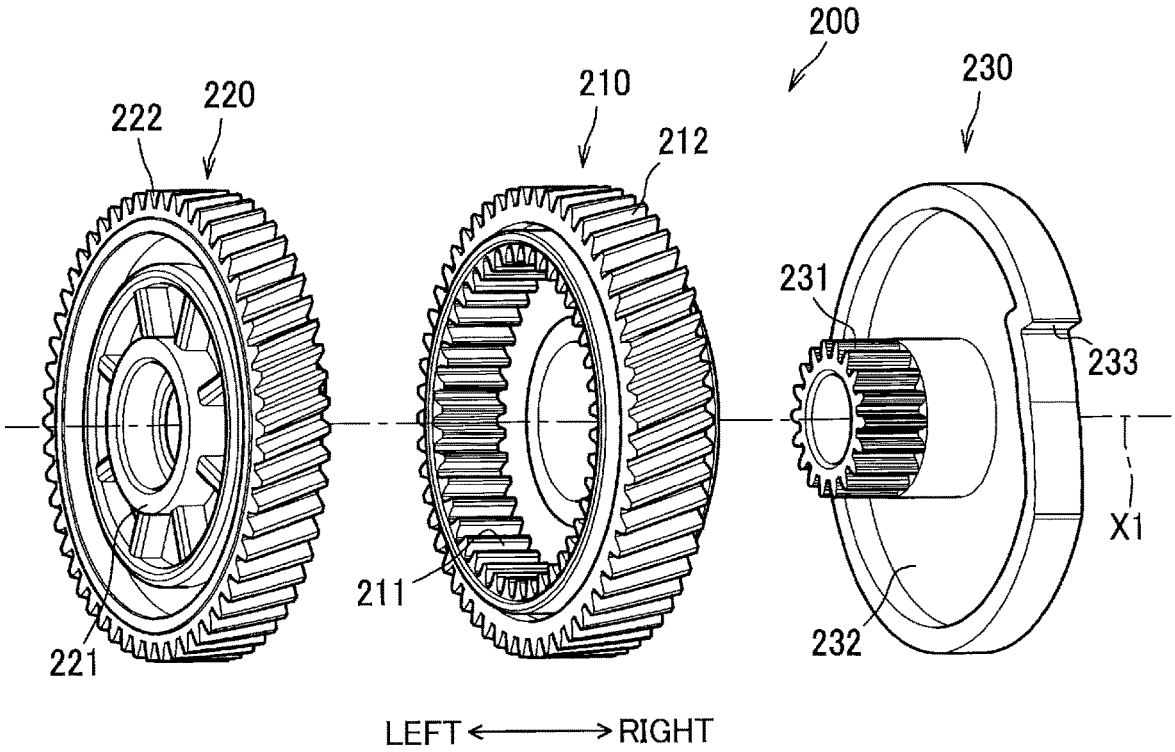
FIG. 7B is an exploded perspective view illustrating the planetary gear mechanism in the image forming apparatus according to the embodiment as viewed from an output element side thereof.
Figure 12:
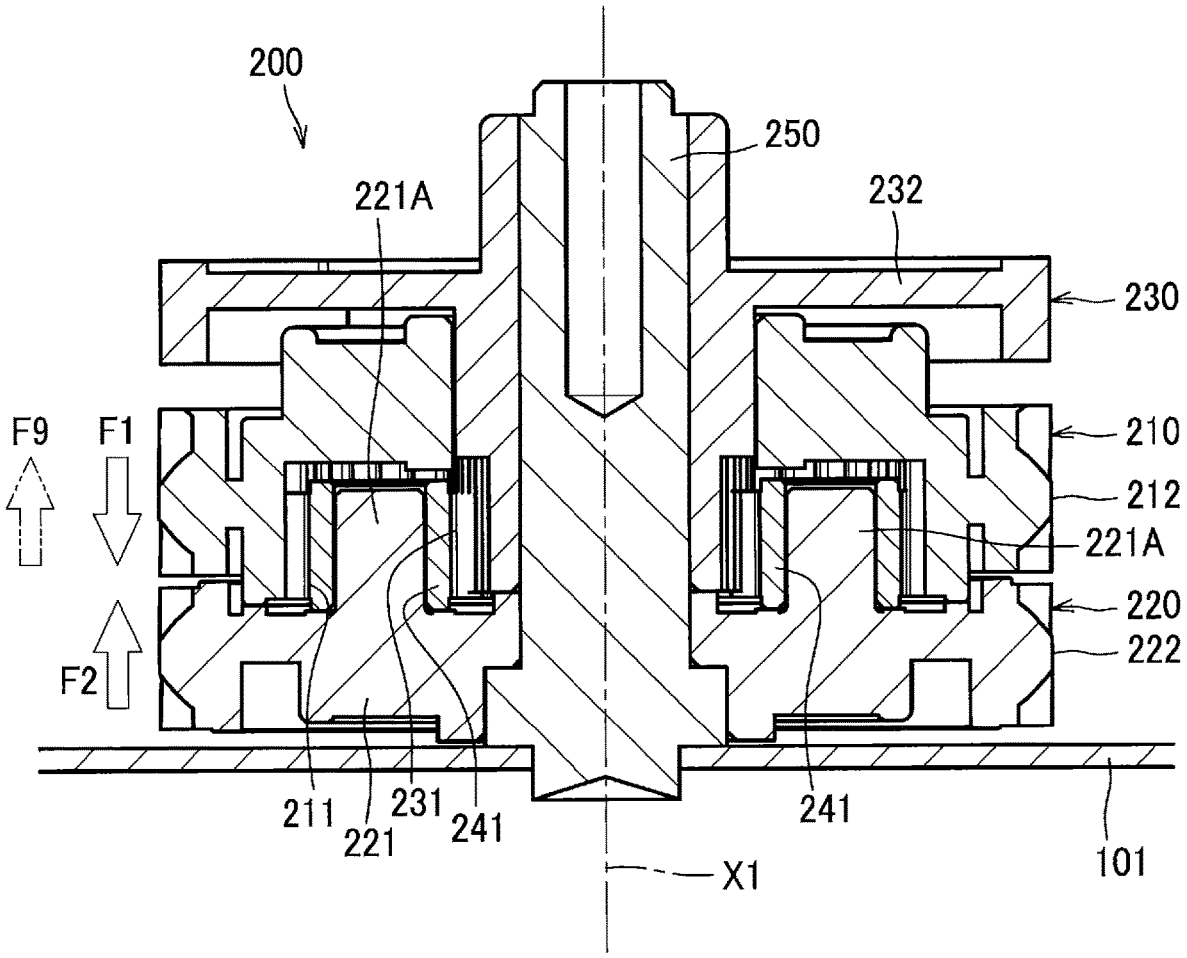
FIG. 12 is a cross-sectional view of the planetary gear mechanism in the image forming apparatus according to the embodiment.

As illustrated in FIGS. 7A and 7B, the planetary gear mechanism 200 includes an input element 210, an output element 220, and a transmission element 230. The input element 210, the output element 220, and the transmission element 230 are rotatably supported by a single shaft 250 fixed to the first plate 101 as illustrated in FIG. 12. Hence, the input element 210, the output element 220, and the transmission element 230 are rotatable coaxially about a center axis X1 of the shaft 250.

Turning back to FIGS. 7A and 7B, the planetary gear mechanism 200 includes a sun gear 231, a ring gear 211, a carrier 221, and a plurality of planetary gears 241. In the planetary gear mechanism 200, one of the input element 210, the output element 220, and the transmission element 230 includes the sun gear 231; another of the input element 210, the output element 220, and the transmission element 230 (the element other than the element including the sun gear 231) includes the ring gear 211; and the other of the input element 210, the output element 220, and the transmission element 230 includes the carrier 221. In the planetary gear mechanism 200 according to the present embodiment, the transmission element 230 includes the sun gear 231, the input element 210 includes the ring gear 211, and the output element 220 includes the carrier 221.

The input element 210 is an element configured to receive the driving force of the motor 3, and includes the ring gear 211 and an input gear 212. The ring gear 211 is an internal gear which is an array of gear teeth provided on an inner periphery thereof, and the input gear 212 is provided on an outer periphery of the ring gear 211. The input gear 212 is a part into which the driving force of the motor 3 is inputted, and is in meshing engagement with the corresponding idle gear 115 (see FIGS. 4 and 10). The input gear 212 is a helical gear as an example of a first helical gear. In the present embodiment, the input gear 212 is a right-handed helical gear whose tooth trace is right-twisted, as illustrated in FIGS. 7A and 7B.

The output element 220 is configured to output the driving force toward the developing roller 61, and includes the carrier 221 and an output gear 222 provided on an outer periphery of the carrier 221. The carrier 221 includes four shaft portions 221A rotatably supporting the respective planetary gears 241. The output gear 222 is a part that can output the driving force toward the developing roller 61, and is in meshing engagement with the corresponding coupling gear 117 (see FIGS. 4 and 10). The output gear 222 is a helical gear as an example of a second helical gear. In the present embodiment, the output gear 222 is a right-handed helical gear whose tooth trace is right-twisted, as illustrated in FIGS. 7A and 7B).

The input element 210 and the output element 220 are positioned adjacent to each other in an axial direction of the planetary gear mechanism 200. The input element 210 and the output element 220 are positioned at the same side of a part (a rotary disc 232 which is described later) of the transmission element 230 in the axial direction of the planetary gear mechanism 200.

The transmission element 230 is configured to allow the driving force to be transmitted from the input element 210 to the output element 220 when rotation thereof is restricted, and to interrupt transmission of the driving force when the rotation is not restricted. The transmission element 230 includes the sun gear 231 serving as a gear part, the rotary disc 232 rotatable integrally with the sun gear 231, and a pawl 233.

The sun gear 231 is a spur gear. The pawl 233 is provided at an outer periphery of the rotary disc 232 to protrude therefrom. One surface of the pawl 233 extends generally perpendicularly to a rotational direction of the transmission element 230, and the other surface of the pawl 233 extends continuously with the outer periphery the transmission element 230 in the rotational direction of the transmission element 230. The single pawl 233 is provided in the transmission element 230.

The four planetary gears 241 are provided to be rotatably supported by respective shaft portions 221A of the carrier 221. The planetary gears 241 are spur gears, and are positioned radially outward of the sun gear 231 so as to surround the sun gear 231 and radially inward of the ring gear 211. The sun gear 231 and the planetary gears 241 are in meshing engagement with each other. Further, the ring gear 211 is in meshing engagement with the planetary gears 241.

When rotation of the transmission element 230 is restricted, the planetary gear mechanism 200 becomes its transmission state where the driving force inputted into the input gear 212 can be transmitted to the output gear 222. On the other hand, the planetary gear mechanism 200 becomes its interruption state where the driving force inputted into the input gear 212 cannot be transmitted to the output gear 222 when the transmission element 230 can be rotated. When a driving force is inputted into the input gear 212 while the planetary gear mechanism 200 is in the interruption state and a load is applied to the output gear 222, the output element 220 cannot be rotated whereas the transmission element 230 makes idle rotation.

Figure 8A:
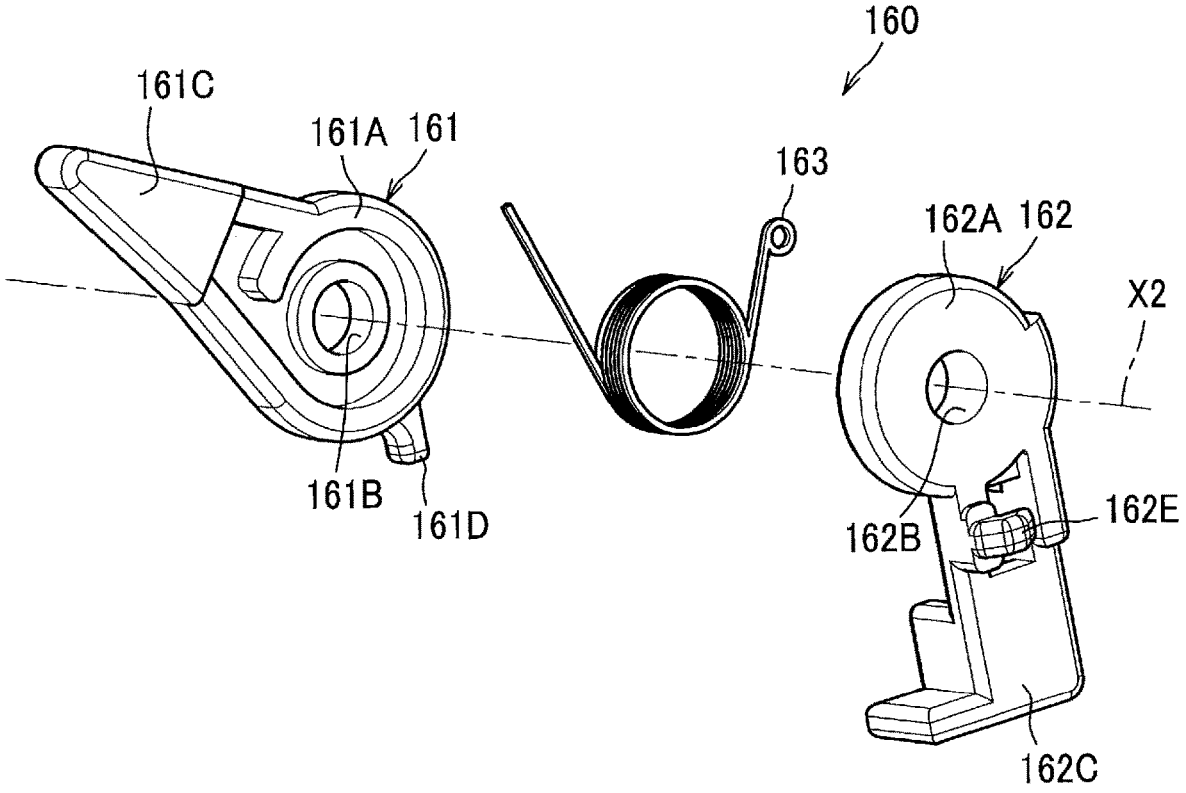
FIG. 8A is an exploded perspective view illustrating the regulation member in the image forming apparatus according to the embodiment.

As illustrated in FIG. 3, each of the regulation members 160 is movably supported by the second plate 102. Specifically, the regulation member 160 is pivotally movable about a pivot axis X2 of a support shaft 102A extending from the second plate 102. As illustrated in FIG. 8A, the regulation member 160 includes a first lever 161, a second lever 162, and a spring 163.

The first lever 161 is pivotally movable about the pivot axis X2 of the support shaft 102A, and can contact the second cam portion 153. The first lever 161 includes a rotary base portion 161A formed with a hole 161B into which the support shaft 102A is inserted, a first arm 161C extending from the rotary base portion 161A, and a protrusion 161D protruding from the rotary base portion 161A in a direction opposite a direction in which the first arm 161C extends.

Figure 8B:
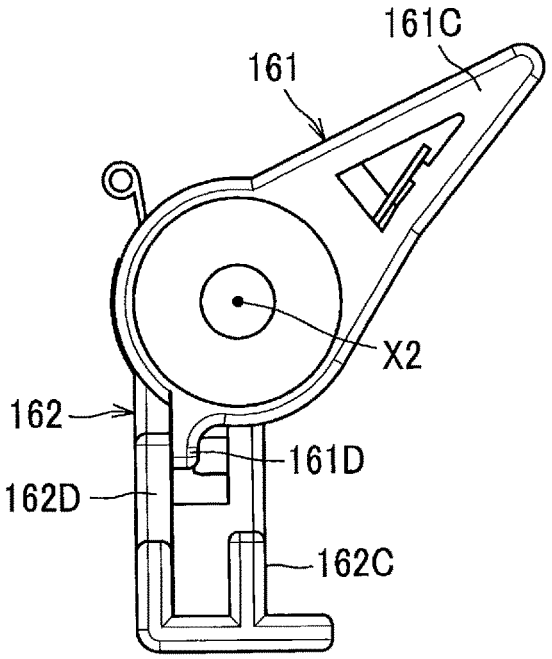
FIG. 8B is a view illustrating a first lever and a second lever of the regulation member in the image forming apparatus according to the embodiment, and particularly illustrating a state where pivotal movement of the first lever in a counterclockwise direction is restricted by a stop portion of the second lever.
Figure 8C:
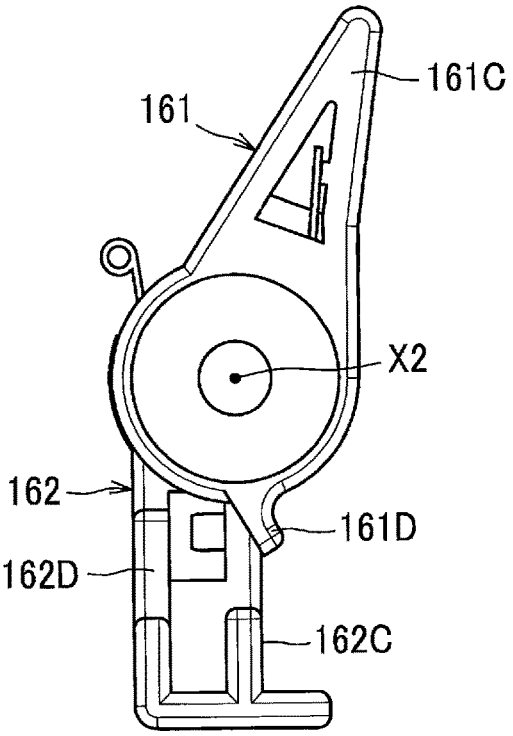
FIG. 8C is a view illustrating the first lever and the second lever of the regulation member in the image forming apparatus according to the embodiment, and particularly illustrating a state where the first lever is pivotally moved in a clockwise direction relative to the second lever.

As illustrated in FIGS. 8B and 8C, the first lever 161 is pivotally movable about the pivot axis X2 relative to the second lever 162. Here, a position of the first lever 161 illustrated in FIG. 8C, i.e., a position of the first lever 161 that has been pivotally moved relative to the second lever 162 will be referred to as a pivoted position.

The second lever 162 is pivotally movable about the pivot axis X2 to be engageable with the transmission element 230. The second lever 162 includes a rotary base portion 162A formed with a hole 162B into which the support shaft 102A is inserted, a second arm 162C extending from the rotary base portion 162A, a stop portion 162D, and a spring hook 162E.

The stop portion 162D protrudes from the second arm 162C in the extending direction of the pivot axis X2. As illustrated in FIG. 8B, the protrusion 161D of the first lever 161 can abut against the stop portion 162D in accordance with pivotal movement of the first lever 161. With this configuration, the stop portion 162D can prevent pivotal movement of the first lever 161 in one direction (a clockwise direction in FIG. 8B) relative to the second lever 162.

The spring 163 is a torsion spring and urges the first lever 161 in a direction in which the protrusion 161D abuts against the stop portion 162D (the clockwise direction in FIG. 8B).

As illustrated in FIGS. 5A and 5B, the second arm 162C has a distal end portion extending toward an outer peripheral surface of the rotary disc 232 of the transmission element 230. The spring hook 162E is provided at the second arm 162C, and one end of a spring is engaged with the spring hook 162E. Specifically, the spring 169 is a tension spring, and has another end engaged with a spring hook (not illustrated) provided at the second plate 102 at a position frontward of the spring hook 162E.

Hence, the spring 169 urges the second lever 162 in the clockwise direction in FIG. 5B. The distal end portion of the second arm 162C is engageable with the pawl 233 of the transmission element 230 to prevent rotation of the transmission element 230 in a counterclockwise direction.

Figure 9A:
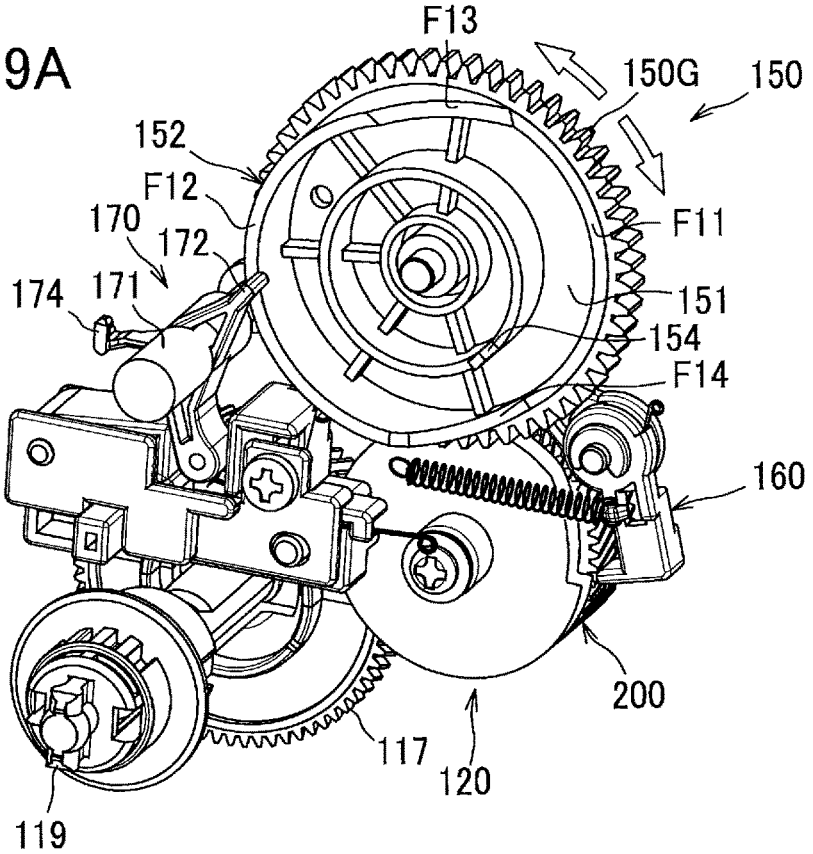
FIG. 9A is a perspective view illustrating the cam, the cam follower, the planetary gear mechanism and the regulation member in the image forming apparatus according to the embodiment, and particularly illustrating a state where the developing roller is in its separated position and the clutch is in its interruption state.
Figure 9B:
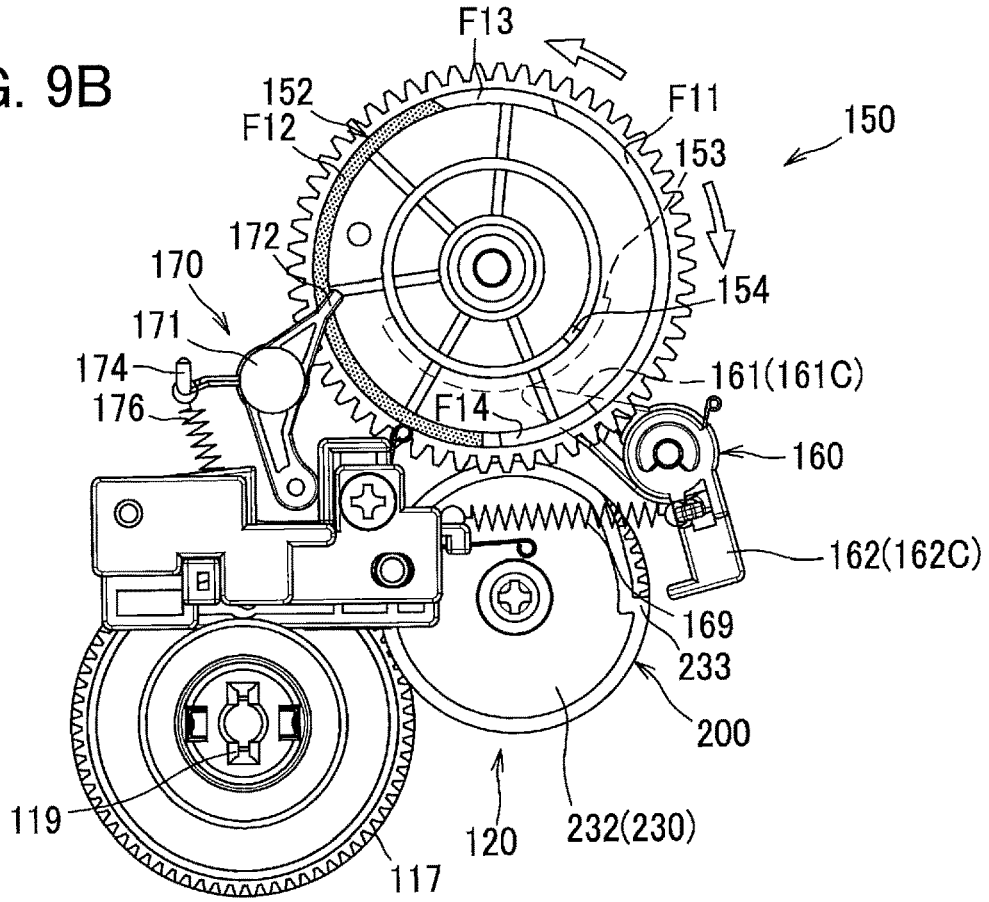
FIG. 9B is a side view illustrating the cam, the cam follower, the planetary gear mechanism and the regulation member in the image forming apparatus according to the embodiment, and particularly illustrating the state where the developing roller is in its separated position and the clutch is in its interruption state.

The regulation member 160 is pivotally movable between a regulating position (a position illustrated in FIGS. 5A and 5B) and a non-regulating position (a position illustrated in FIGS. 9A and 9B). In the regulating position of the regulation member 160, a distal end portion of the first lever 161 (the first arm 161C) is separated from the second cam portion 153, and the distal end portion of the second lever 162 (the second arm 162C) is engaged with the pawl 233 to prevent the transmission element 230 from rotating. In the non-regulating position of the regulation member 160, the distal end portion of the first lever 161 abuts against the second cam portion 153 to pivotally move the second lever 162, so that the distal end portion of the second lever 162 is disengaged from the pawl 233 to allow the transmission element 230 to be rotated.

The clutch 120 is in the transmission state while the regulation member 160 is positioned at the regulating position, and is in the interruption state while the regulation member 160 is positioned at the non-regulating position.

Further, when the motor 3 makes reverse rotation to rotate the cam 150 in the counterclockwise direction in FIGS. 5A and 5B to cause the second cam portion 153 to press the first lever 161 from a state illustrated in FIGS. 5A and 5B, the first lever 161 is pivotally moved relative to the second lever 162 against the urging force of the torsion spring 163 while the second lever 162 maintains engagement with the pawl 233. As a result, the first lever 161 is moved to the pivoted position illustrated in FIG. 8C. Accordingly, application of excessive force to the regulation member 160 can be avoided when the motor 3 makes reverse rotation.

The controller 2 is configured to control overall operations performed in the image forming apparatus 1. The controller 2 includes CPU, ROM, RAM, and input/output unit, and etc., and performs various processing by executing various programs stored in advance. Specifically, the controller 2 is configured to control rotation of the motor 3, and to control ON/OFF state of the YMC clutch 140A and the K clutch 140K to control operation of the cams 150 to thus control rotation of the developing rollers 61 and contact and separation of the developing rollers 61 relative to the corresponding photosensitive drums 50.

An example of processing performed by the controller 2 will be described. In a standby state of the image forming apparatus 1 prior to image forming operation, all of the developing rollers 61 are at their respective separated positions. At this time, each cam follower 170 is at the protruding position where the contact portion 172 is in contact with the second holding surface F12 of the cam 150 as illustrated in FIGS. 9A and 9B.

In order to perform image forming operation upon input of a print job, the controller 2 controls the motor 3 to start forward rotation, and at the same time, controls the YMC clutch 140A and the K clutch 140K to be switched to the ON state to rotate the cam(s) 150 in the clockwise direction in FIGS. 9A and 9B in accordance with the color(s) used in the image forming operation. Accordingly, the contact portion 172 of the cam follower 170 in contact with the second holding surface F12 is guided to and slidingly moved on the second guide surface F14, and is brought into contact with the first holding surface F11 as illustrated in FIGS. 5A and 5B.

As a result, the cam follower 170 is slidingly moved from the protruding position to the standby position by the urging force of the springs 176 and 194, thereby causing the developing roller 61 to be moved from the separated position to the contact position. The controller 2 controls the YMC clutch 140A and the K clutch 140K to be switched to the OFF state to stop rotation of the cam(s) 150 when the developing roller 61 has been moved to the contact position.

When the developing operation by the developing roller 61 is completed, the controller 2 controls the YMC clutch 140A and the K clutch 140K to be switched to the ON state to again rotate the cam(s) 150. Hence, the contact portion 172 guided by the first holding surface F11 is then slidingly moved on the first guide surface F13, and is brought into contact with the second holding surface F12 as illustrated in FIGS. 9A and 9B.

As a result, the cam follower 170 is slidingly moved from the standby position to the protruding position against the urging force of the springs 176 and 194, whereby the developing roller 61 is moved from the contact position to the separated position. Then, the controller 2 controls the YMC clutch 140A and the K clutch 140K to be switched to the OFF state to stop the rotation of the cam(s) 150 upon receiving signals outputted from the separation sensors 4C and 4K.

In the meantime, when the opened front cover (see FIG. 1) has been closed, the controller 2 controls the motor 3 to make reverse rotation and controls the YMC clutch 140A and the K clutch 140K to be switched to the ON state to allow the cams 150 to be rotated in the counterclockwise direction in FIGS. 5A and 5B in order to position the developing rollers 61 at their separated positions (the positions of the developing rollers 61 when the image forming apparatus 1 is in the standby position). Then, the controller 2 controls the YMC clutch 140A and the K clutch 140K to be switched to the OFF state to stop the rotations of the cams 150 when each of the separation sensors 4C and 4K outputs a signal twice.

During the rotation of the cam 150 in the counterclockwise direction, the contact portion 172 guided by the first holding surface F11 is then slidingly moved on the second guide surface F14, and is brought into contact with the second holding surface F12. Accordingly, the cam follower 170 is moved from the standby position to the protruding position to move the developing roller 61 from the contact position to the separated position.

Thereafter, the contact portion 172 guided on the second holding surface F12 is slidingly moved on the first guide surface F13, and is again brought into contact with the first holding surface F11 so that the cam follower 170 is moved from the protruding position to the standby position, thereby moving the developing roller 61 from the separated position to the contact position.

After the cams 150 stop rotating, the controller 2 controls the motor 3 to make forward rotation and controls the YMC clutch 140A and the K clutch 140K to be switched to the ON to start rotation of the cams 150. Then, the controller 2 controls the YMC clutch 140A and the K clutch 140K to be switched to the OFF state to stop the rotation of the cams 150 when each of the separation sensors 4C and 4K outputs a signal. Accordingly, the developing rollers 61 can be positioned at their separated positions while the image forming apparatus 1 is in the standby state.

Figure 10:
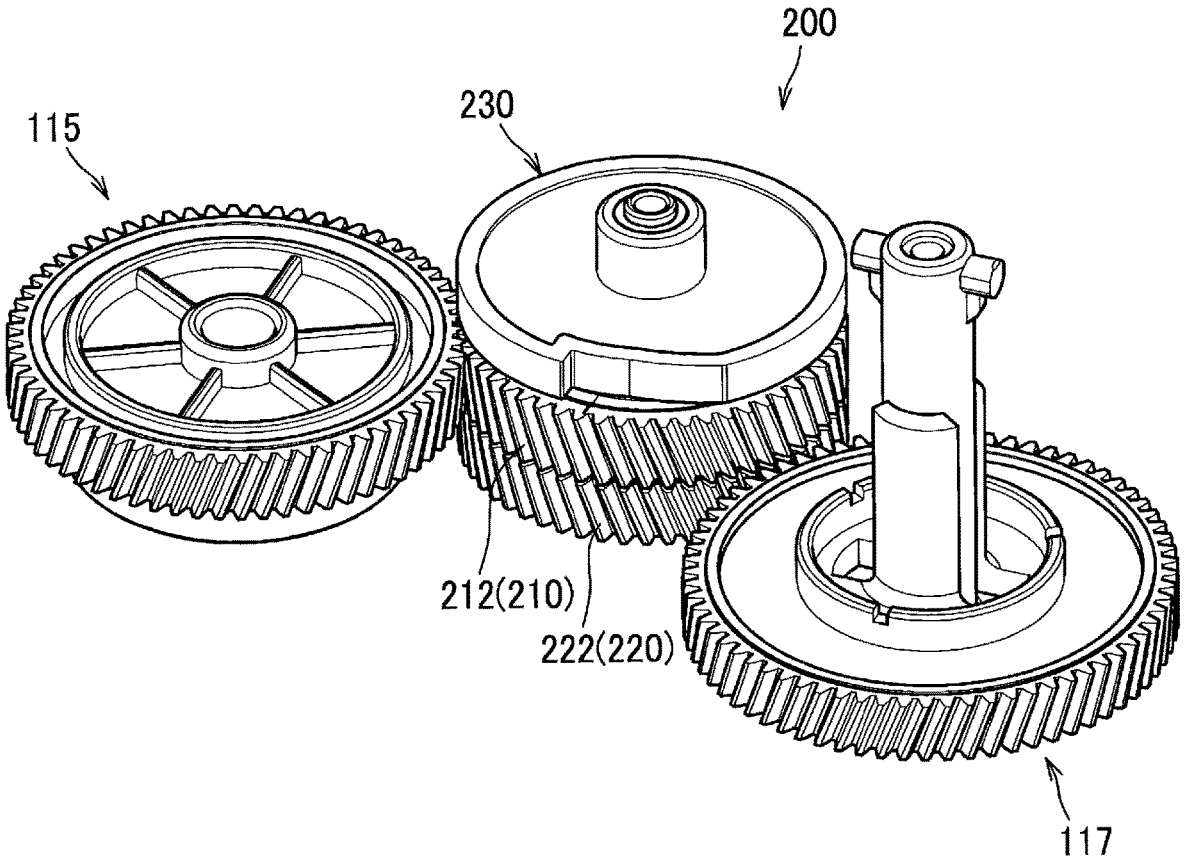
FIG. 10 is a perspective view illustrating the planetary gear mechanism, an idle gear in meshing engagement with an input gear of the planetary gear mechanism, and a coupling gear in meshing engagement with an output gear of the planetary gear mechanism in the image forming apparatus according to the embodiment.
Figure 11:
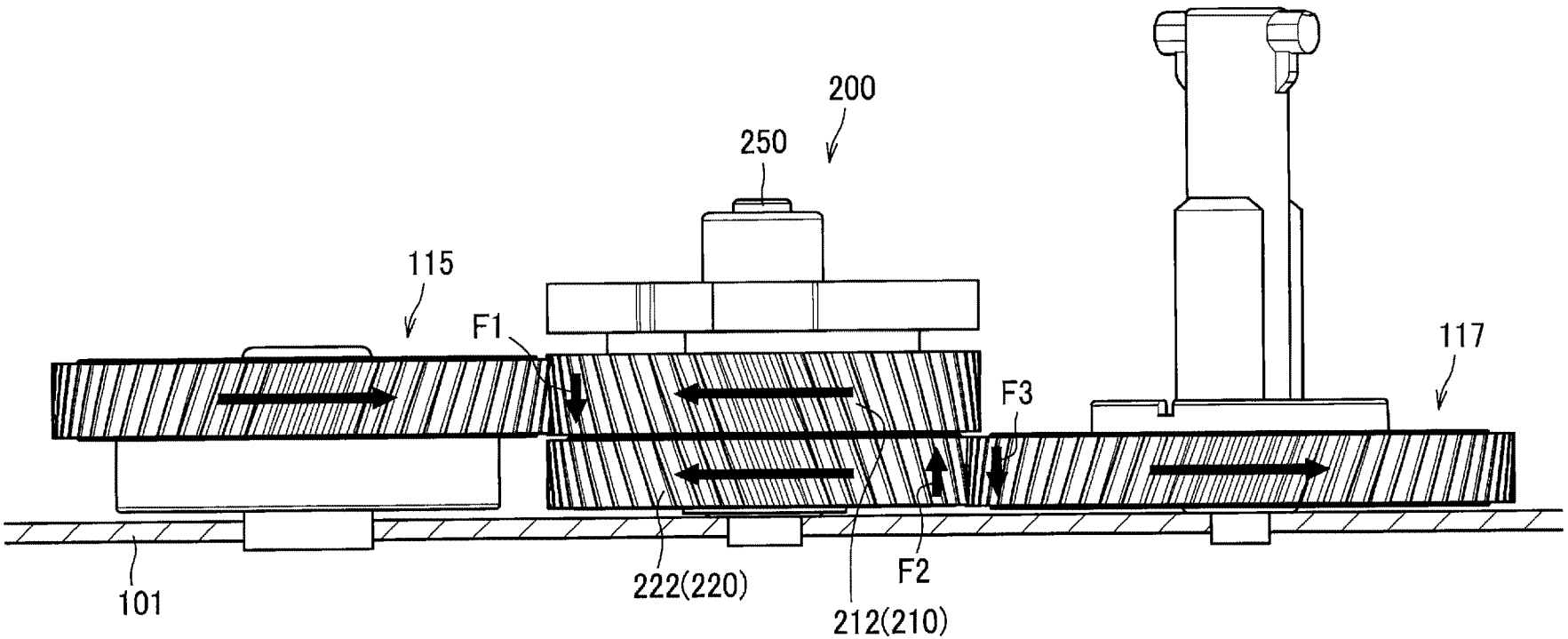
FIG. 11 is a side view of the planetary gear mechanism, the idle gear, and the coupling gear in the image forming apparatus according to the embodiment.

As illustrated in FIGS. 10 and 11, the idle gear 115 in meshing engagement with the input gear 212 is a helical gear as similar to the input gear 212. Also, the coupling gear 117 in meshing engagement with output gear 222 is a helical gear as similar to the output gear 222. The first plate 101 is in a form of sheet metal rotatably supporting the planetary gear mechanism 200, the idle gear 115 and the coupling gear 117.

Note that, in FIG. 11, the idle gear 115, the planetary gear mechanism 200, and the coupling gear 117 are arrayed in line as a matter of convenience.

As illustrated in FIG. 11, the meshing engagement between the input gear 212 and the idle gear 115 generates a first thrust force F1 applied to the input gear 212, and the meshing engagement between the output gear 222 and the coupling gear 117 generates a second thrust force F2 applied to the output gear 222.

Here, the input gear 212 and the output gear 222 are disposed such that a direction in which the first thrust force F1 is applied and a direction in which the second thrust force F2 is applied are opposite to each other. Specifically, the input gear 212 is configured such that the first thrust force F1 is directed toward the output element 220, and the output gear 222 is configured such that the second thrust force F2 is directed toward the input element 210 in the present embodiment. An extending direction in which the gear teeth of the input gear 212 are elongated is the same as an extending direction in which the gear teeth of the output gear 222 are elongated. Note that, since the input gear 212 and the output gear 222 are helical gears, the extending direction of the gear teeth of the input gear 212 and the output gear 222 are inclined relative to the axial direction of the planetary gear mechanism 200 (i.e., the rotation axis X1). In other words, the input gear 212 and the output gear 222 are helical gears of the same hand.

The meshing engagement between the coupling gear 117 and the output gear 222 generates a third thrust force F3 applied to the coupling gear 117. Here, the coupling gear 117 is configured such that the third thrust force F3 is directed toward the first plate 101. The extending direction of the gear teeth of the output gear 222 and an extending direction in which the gear teeth of the coupling gear 117 are elongated are opposite to each other. The extending direction of the coupling gear 117 is also inclined relative to the axial direction of the planetary gear mechanism 200. In other words, the output gear 222 and the coupling gear 117 are helical gears of different hand.

The coupling gear 117 is an example of a third helical gear, and the first plate 101 is an example of a sheet metal.

In the image forming apparatus 1 according to the above-described embodiment, the input gear 212 of the input element 210 into which the driving force of the motor 3 is inputted and the output gear 222 of the output element 220 for outputting the driving force toward the developing roller 61 are helical gears. Hence, rotational unevenness of the input element 210 and the output element 220 can be restrained, thereby attaining stabilized rotations of the input element 210 and the output element 220.

Further, as illustrated in FIG. 12, since the direction of the first thrust force F1 applied to the input gear 212 and the direction of the second thrust force F2 applied to the output gear 222 are opposite to each other, a case can be avoided where a concentrated force is applied toward one side in the axial direction of the planetary gear mechanism 200, and inclination of the input element 210 and the output element 220 relative to the rotation axis X1 can be restrained. As a result, stabilized driving of the planetary gear mechanism 200 can be attained.

Here, assuming that a first thrust force F9 (indicated by two-dotted chain line in FIG. 12) generated by meshing engagement between the idle gear 115 and the input gear 212 and applied to the input gear 212 and the second thrust force F2 applied to the output gear 222 were directed in the same direction (toward the transmission element 230 in FIG. 12), both the input element 210 and the output element 220 press the transmission element 230, and therefore, unnecessary force that disturbs rotation of the transmission element 230 may be applied to the transmission element 230.

Further, as illustrated in FIG. 4, the idle gear 115 and the coupling gear 117 are positioned at the same side with respect to a linear line L1 (see FIG. 4) passing through the rotation axis X1 of the planetary gear mechanism 200. That is, an angle defined by a line passing through both the rotation axis X1 and a center of the coupling gear 117 and a line passing through both the rotation axis X1 and a center of the idle gear 115 is less than 180 degrees. Therefore, a position in which the input gear 212 and the idle gear 115 are in meshing engagement with each other and a position in which the output gear 222 and the coupling gear 117 are meshing engagement with each other are close to each other.

With such a structure, if the first thrust force F9 were generated between the idle gear 115 and the input gear 212 and applied to the input gear 212, a portion in which the input gear 212 is in meshing engagement with and the idle gear 115 were urged upward in FIG. 12 by the first thrust force F9, and at the same time, the portion adjacent to the portion in which the input gear 212 is in meshing engagement with and the idle gear 115 were pressed upward by the output gear 222 urged upward in FIG. 12 by the second thrust force F2, and hence, the input gear 212 were likely to be inclined with respect to the rotation axis X1.

In contrast, since the first thrust force F1 and the second thrust force F2 are directed in directions opposite to each other in the present embodiment, the transmission element 230 is not pressed by both the input element 210 and the output element 220.

Further, in the present embodiment, the first thrust force F1 and the second thrust force F2 are mutually canceled, since the first thrust force F1 is directed toward the output element 220 whereas the second thrust force F2 is directed toward the input element 210. Specifically, since the extending direction of the gear teeth of the input gear 212 is the same as the extending direction of the gear teeth of the output gear 222, the first thrust force F1 and the second thrust force F2 can be directed in directions opposite to each other. Hence, the first thrust force F1 and the second thrust force F2 are canceled by each other.

With this configuration, the transmission element 230 is not pressed by the input element 210 and the output element 220. Further, because of the mutual cancelation of the first thrust force F1 and the second thrust force F2, inclination of the input element 210 and the output element 220 relative to the rotation axis X1 can further be restrained, and accordingly, stabilized driving of the planetary gear mechanism 200 can further be secured.

Further, since the third thrust force F3 applied to the coupling gear 117 is directed toward the first plate 101, the third thrust force F3 can urge the coupling gear 117 toward the first plate 101, thereby stably positioning the coupling gear 117 in the axial direction.

Further, since the sun gear 231 and the planetary gears 241 are spur gears and the ring gear 211 is the internal gear in meshing engagement with these spur gears, the ring gear 211 (the input element 210), the carrier 221 (the output element 220) supporting the planetary gears 241, and the sun gear 231 (the transmission element 230) can be easily assembled together. Hence, the planetary gear mechanism 200 can be easily assembled.

Further, the roller to which the driving force is transmitted from the planetary gear mechanism 200 is the developing roller 61. Therefore, stable driving of the planetary gear mechanism 200 can lead to stable rotation of the developing roller 61. As a result, stable developing operation can be performed by the developing roller 61, thereby improving a quality of an image formed in the image forming apparatus 1.

While the description has been made in detail with reference to the embodiment, it would be apparent to those skilled in the art that various changes and modifications may be made thereto.

For example, in the above-described embodiment, the transmission element 230 includes the single pawl 233. Instead, the transmission element 230 may include a plurality of pawls.

Further, in the above-described embodiment, the input gear 212 (the first helical gear) is configured such that the first thrust force F1 is directed toward the output element 220, and the output gear 222 (the second helical gear) is configured such that the second thrust force F2 is directed toward the input element 210. As a modification, the first helical gear may be configured such that the first thrust force F1 is a direction in a direction away from the output element 220, and the second helical gear may be configured such that the second thrust force F2 is directed in a direction away from the input element 210.

Further, while the regulation member 160 is pivotally movable between the regulating position and the non-regulating position in the above-described embodiment, the regulation member 160 may be configured to be slidingly movable between the regulating position and the non-regulating position.

Further, in the image forming apparatus 1 according to the above-described embodiment, the developing roller 61 serves as a roller. However, any rollers other than the developing roller in the image forming apparatus 1 may serve as a roller. For example, a photosensitive drum, a supply roller for supplying toner to the developing roller, a charge roller for charging the photosensitive drum, a cleaning roller for collecting residual toner from the photosensitive drum, a feed roller (a pick-up roller) for feeding a sheet from a sheet tray, and a conveyer roller for conveying a sheet can be employed as a roller.

Further, while the sun gear 231 and the planetary gears 241 are spur gears, and the ring gear 211 is an internal gear in the above-described embodiment, the sun gear and the planetary gears may be helical gears, and the ring gear may be an helical internal gear instead.

Further, in the above-described embodiment, the transmission element 230 includes the sun gear 231, the input element 210 includes the ring gear 211, and the output element 220 includes the carrier 221. However, other combinations may be conceivable.

Further, while both the input gear 212 and the output gear 222 are right-hand helical gears in the above-described embodiment, the input gear 212 and the output gear 222 may be left-hand helical gears instead. In other words, hand of the input gear 212 and the output gear 222 is arbitrary as long as these input gear 212 and output gear 222 are helical gears of the same hand.

Further, according to the above-described embodiment, the image forming apparatus 1 is a color printer that can form an image using toners of four colors. However, an image forming apparatus of the present disclosure may employ toners of three colors or not less than five colors for forming a color image. Alternatively, a monochromatic printer that forms an image using toner of single color is also available as the image forming apparatus of the disclosure. Further, not only a printer, but also a multifunction peripheral and a copying machine are available as the image forming apparatus of the present disclosure.

Further, the parts and components employed in the above-described embodiment and modifications can be implemented combined as appropriate.

What is claimed is:

1. An image forming apparatus comprising:
a motor;
a roller; and
a power transmission device capable of transmitting a driving force of the motor to the roller,
the power transmission device comprising:
a planetary gear mechanism comprising:
an input element comprising a first helical gear into which the driving force of the motor is inputted;
an output element comprising a second helical gear for outputting the driving force to the roller; and
a transmission element rotatable to transmit the driving force from the input element to the output element, wherein the transmission element is capable of transmitting the driving force from the input element to the output element when rotation of the transmission element is restricted, whereas the transmission element does not transmit the driving force from the input element to the output element when the rotation of the transmission element is not restricted; and
a restriction member movable between:
a restricting position where the restriction member restricts the rotation of the transmission element; and
a non-restricting position where the restriction member does not restrict the rotation of the transmission element,
wherein the input element, the output element, and the transmission element are rotatable coaxially,
wherein the input element and the output element are positioned adjacent to each other in an axial direction of the planetary gear mechanism, and
wherein the first helical gear and the second helical gear are provided so that a direction of a first thrust force applied to the first helical gear and a direction of a second thrust force applied to the second helical gear are opposite to each other.

2. The image forming apparatus according to claim 1,
wherein the first helical gear is provided so that the direction of the first thrust force is directed to the output element, and
wherein the second helical gear is provided so that the direction of the second thrust force is directed to the input element.

3. The image forming apparatus according to claim 1,
wherein each of the first helical gear and the second helical gear has a gear tooth elongated in an extending direction that is inclined relative to the axial direction of the planetary gear mechanism, and
wherein the extending direction of the gear tooth of the first helical gear and the extending direction of the gear tooth of the second helical gear are the same as each other.

4. The image forming apparatus according to claim 1, further comprising:
a third helical gear in meshing engagement with the second helical gear; and
a sheet metal rotatably supporting the third helical gear,
wherein the third helical gear is provided so that a direction of a third thrust force applied to the third helical gear is directed to the sheet metal.

5. The image forming apparatus according to claim 1,
wherein the planetary gear mechanism comprises a sun gear, a ring gear, a carrier, and a planetary gear,
wherein one of the input element, the output element, and the transmission element comprises the sun gear,
wherein another of the input element, the output element, and the transmission element comprises the ring gear, and
wherein the other of the input element, the output element, and the transmission element comprises the carrier.

6. The image forming apparatus according to claim 5,
wherein the transmission element comprises the sun gear,
wherein the input element comprises the ring gear, and
wherein the output element comprises the carrier.

7. The image forming apparatus according to claim 5,
wherein the sun gear and the planetary gear are spur gears and in meshing engagement with each other, and wherein the ring gear is an internal gear and in meshing engagement with the planetary gear.

8. The image forming apparatus according to claim 1, wherein the transmission element comprises:

a gear part;

a rotary disc rotatable integrally with the gear part; and a single pawl provided at an outer periphery of the rotary disc, wherein, in the restricting position, the restriction member is in engagement with the single pawl, and wherein, in the non-restricting position, the restriction member is separated from the single pawl.

9. The image forming apparatus according to claim 1, wherein the roller is a developing roller.

10. An image forming apparatus comprising:

a motor;

a roller; and a power transmission device capable of transmitting a driving force of the motor to the roller, the power transmission device comprising:

a planetary gear mechanism comprising:

a first helical gear into which the driving force of the motor is inputted;

a second helical gear for outputting the driving force to the roller; and a transmission element rotatable to transmit the driving force from the first helical gear to the second helical gear, wherein the transmission element is capable of transmitting the driving force from the first helical gear to the second helical gear when rotation of the transmission element is restricted, whereas the transmission element does not transmit the driving force from the first helical gear to the second helical gear when the rotation of the transmission element is not restricted; and a restriction member movable between:

a restricting position where the restriction member restricts the rotation of the transmission element; and a non-restricting position where the restriction member does not restrict the rotation of the transmission element, wherein the first helical gear and the second helical gear are positioned adjacent to each other in an axial direction of the planetary gear mechanism, and wherein the first helical gear and the second helical gear are helical gears of the same hand.

11. The image forming apparatus according to claim 10, wherein the first helical gear is a right-hand helical gear, and the second helical gear is a right-hand helical gear.

* * * * *